US007189124B2

(12) United States Patent
Kobayashi et al.

(10) Patent No.: US 7,189,124 B2
(45) Date of Patent: Mar. 13, 2007

(54) TERMINAL FITTING AND METHOD OF FORMING IT

(75) Inventors: Yutaka Kobayashi, Yokkaichi (JP); Hajime Kawase, Yokkaichi (JP); Yutaka Noro, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/344,754

(22) Filed: Feb. 1, 2006

(65) Prior Publication Data

US 2006/0172619 A1 Aug. 3, 2006

(30) Foreign Application Priority Data

Feb. 2, 2005 (JP) ..... 2005-026660

(51) Int. Cl.
*H01R 11/22* (2006.01)

(52) U.S. Cl. ..... 439/852; 439/850

(58) Field of Classification Search ..... 439/851, 439/852, 843, 296, 20, 842, 839, 850
See application file for complete search history.

(56) References Cited

U.S. PATENT DOCUMENTS

| | | | | |
|---|---|---|---|---|
| 5,235,743 | A | 8/1993 | Endo et al. | |
| 5,593,328 | A * | 1/1997 | Okada et al. | 439/851 |
| 5,989,078 | A * | 11/1999 | Chaillot et al. | 439/851 |
| 6,450,843 | B1 * | 9/2002 | Heimuller | 439/852 |
| 6,626,702 | B2 * | 9/2003 | Kurimoto et al. | 439/595 |
| 2003/0049975 | A1 | 3/2003 | Tsuji et al. | |
| 2003/0096533 | A1 | 5/2003 | Kojima et al. | |

* cited by examiner

*Primary Examiner*—James Harvey
*Assistant Examiner*—Travis Chambers
(74) *Attorney, Agent, or Firm*—Gerald E. Hespos; Anthony J. Casella

(57) ABSTRACT

A terminal fitting (T) has a tube (10) formed by at least one plate (12). A locking hole (19) is formed in the plate (12) and is engageable by a lock (52) of a connector housing (50). The plate (12) is deformed into the tube (10) adjacent the locking hole (19) to form a retaining portion (22) that enlarges an area of engagement with the lock (52) for holding the terminal fitting (T) more securely in the connector housing (50).

4 Claims, 12 Drawing Sheets

TERMINAL FITTING AND METHOD OF FORMING IT

BACKGROUND OF THE INVENTION

1. Field of the Invention

The invention relates to a terminal fitting and a method of forming it.

2. Description of the Related Art

U.S. Pat. No. 5,235,743 discloses a terminal fitting that has a rectangular tube formed by four plates. A locking hole is formed in a first of the plates of the rectangular tube. The terminal fitting is insertable into a cavity of a connector housing. A resiliently deformable lock is provided at an inner wall of the cavity and engages the locking hole of the terminal fitting to hold the terminal fitting in the cavity.

Consideration has been given to bending the first plate of the rectangular tube inward substantially at a right angle at an edge of a locking hole to form a locking wall. The locking wall could provide a larger engaging area than the edge of the plate at the locking hole, and hence the locking wall might provide more secure engagement with the resiliently deformable lock in the housing.

However, a curved surface is defined at the bend between the locking wall and the first plate of the rectangular tube. Thus, slippage occurs between the locking wall and the resiliently deformable lock of the housing when an external force acts on the terminal fitting in withdrawing direction. As a result, the lock may deform resiliently and disengage from the locking wall.

The present invention was developed in view of the above problem, and an object thereof is to improve the reliability of a retaining function by the engagement of a locking portion and a locking hole.

SUMMARY OF THE INVENTION

The invention relates to a terminal fitting to be inserted into a cavity of a connector housing and to be held therein by an engagement with a lock of the housing. The terminal fitting has a tube and a locking hole is formed in a wall of the tube. The wall that has the locking hole is deformed inwardly adjacent the locking hole so that an opening edge of the locking hole defines a retaining portion to be engaged with the lock.

The end surface of the plate at the opening edge of the locking hole can contact the lock to retain the terminal fitting. This end surface is displaced inwardly of the tube to define a larger engaging margin than a case where the engaging margin with the lock is defined merely by the thickness of the plate.

The portion of the wall of the terminal fitting that is deformed to define the retaining portion preferably is opposed to the lock. Accordingly, a boundary between the outer surface of the plate and the end surface at the locking hole is an angled edge. Thus, an external force acts on the terminal fitting in withdrawing direction is not likely to cause the lock to slip and disengage from the retaining portion, as in the case where the boundary between the outer surface of the plate and the end surface is curved.

A resilient contact preferably is accommodated in the tube. The resilient contact can contact the retaining portion to prevent deformation of the resilient contact beyond the deformation that occurs when the resilient contact is in contact with a tab. Accordingly, the shape of the terminal fitting can be simpler than if a separate excessive deformation preventing portion is provided.

The tab may be held resiliently between the resilient contact and a surface of the tube substantially opposite the surface with the locking hole.

The widthwise center of the resilient contact preferably substantially coincides with that of the retaining portion.

Two locking plates preferably are provided on a surface of the tube to prevent displacement of the resilient contact at an angle to the deforming direction when contacting the tab.

The widthwise center of resilient contact preferably is deviated from the widthwise center of the tube.

An area of the tube adjacent the locking hole is embossed or bent in to form an intrusion restricting portion in the opening area of the locking hole. The intrusion restricting portion preferably is outside a deformation space for the resilient contact with respect to a width direction.

These and other features of the invention will become more apparent upon reading of the following detailed description and accompanying drawings. It should be understood that even though embodiments are described separately, single features thereof may be combined.

DETAILED DESCRIPTION OF THE PREFERRED EMBODIMENTS

Figure 1:
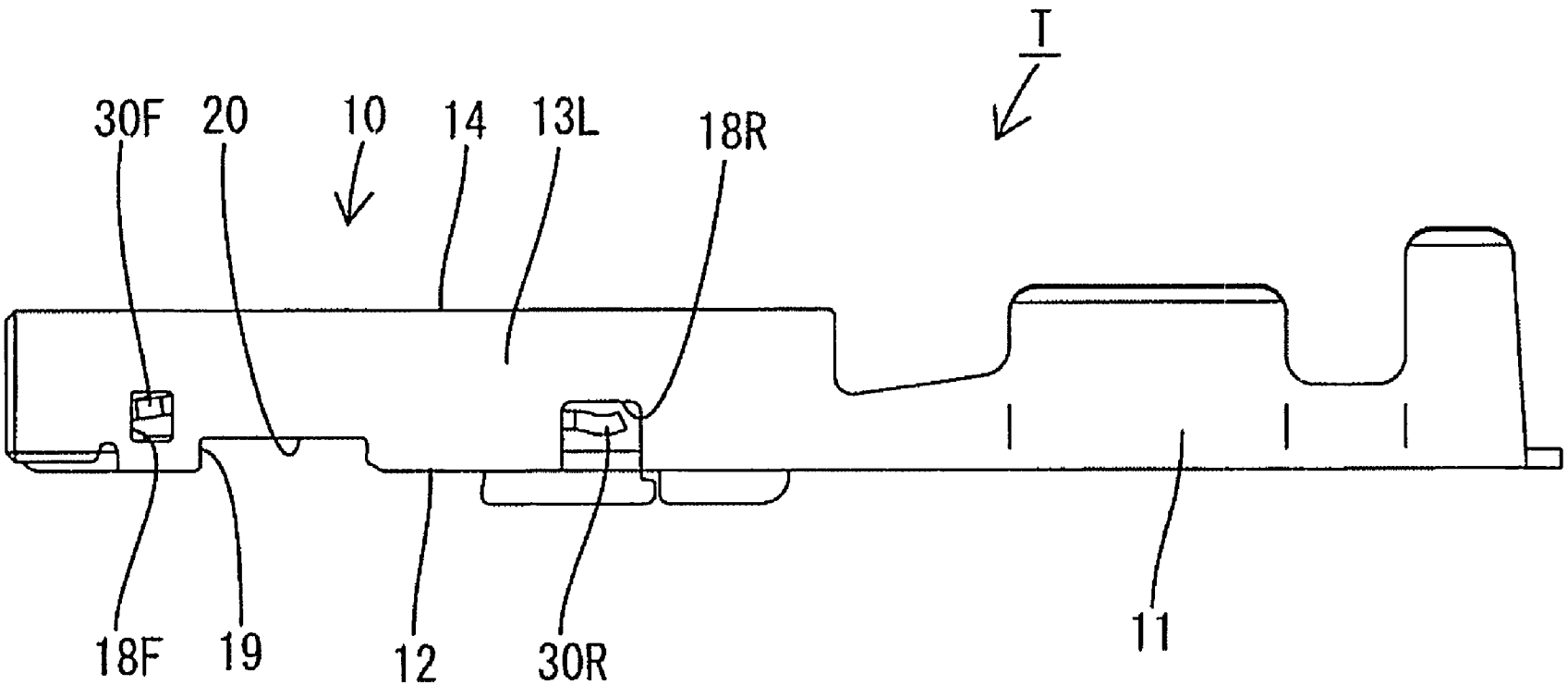
FIG. 1 is a right side view of a terminal fitting according to one embodiment of the invention.
Figure 2:
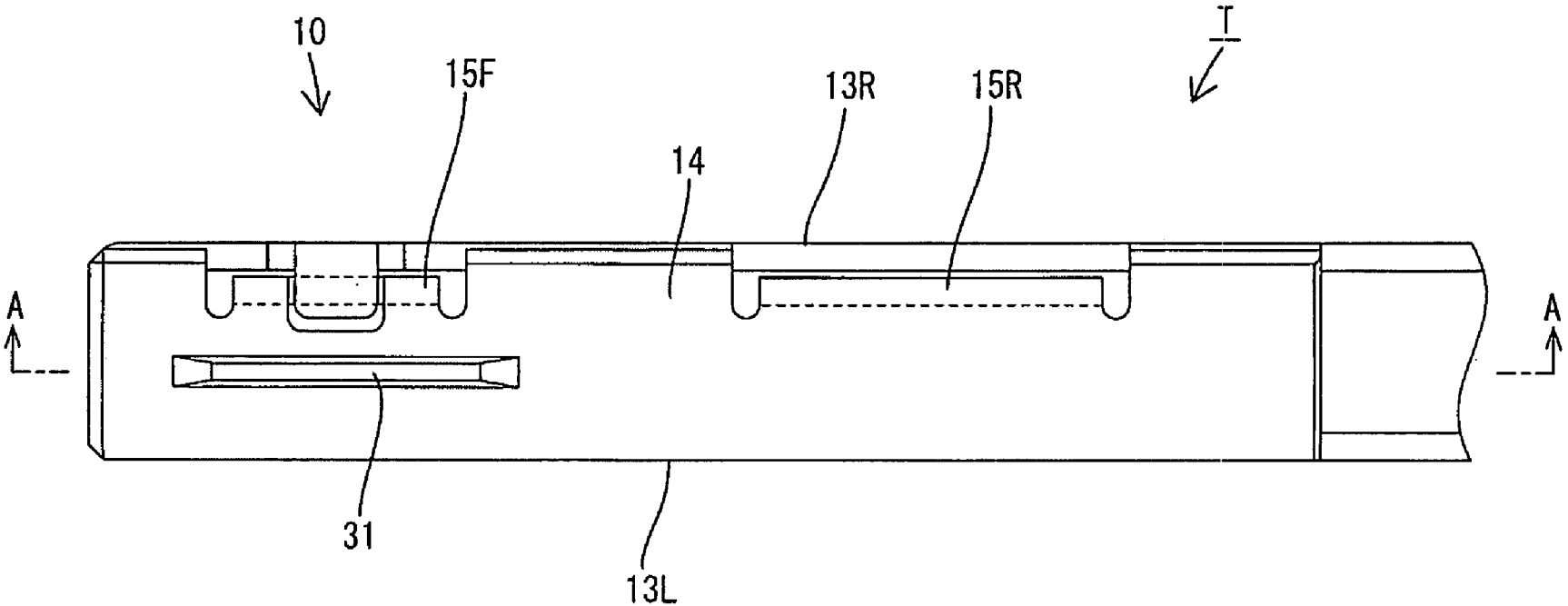
FIG. 2 is a plan view of the terminal fitting.
Figure 3:
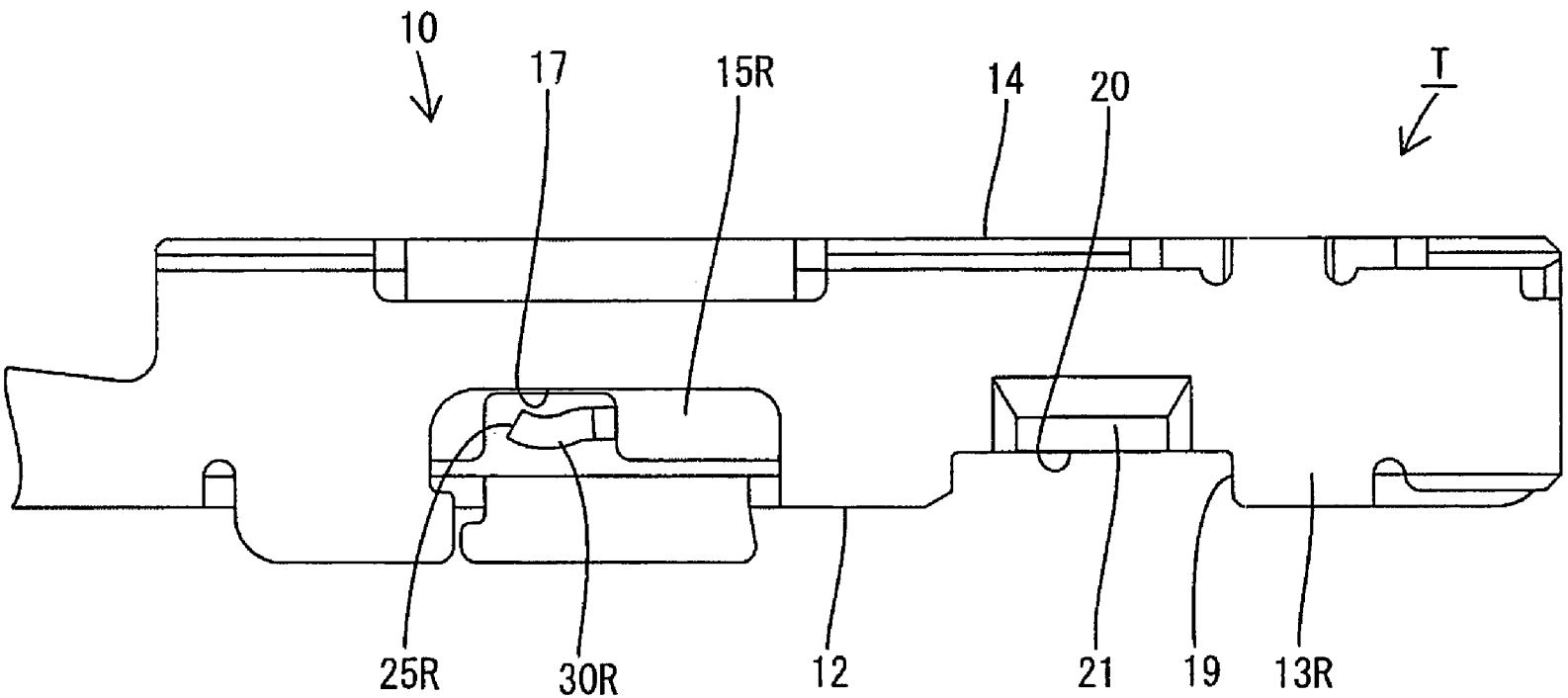
FIG. 3 is a left side view of the terminal fitting.
Figure 4:
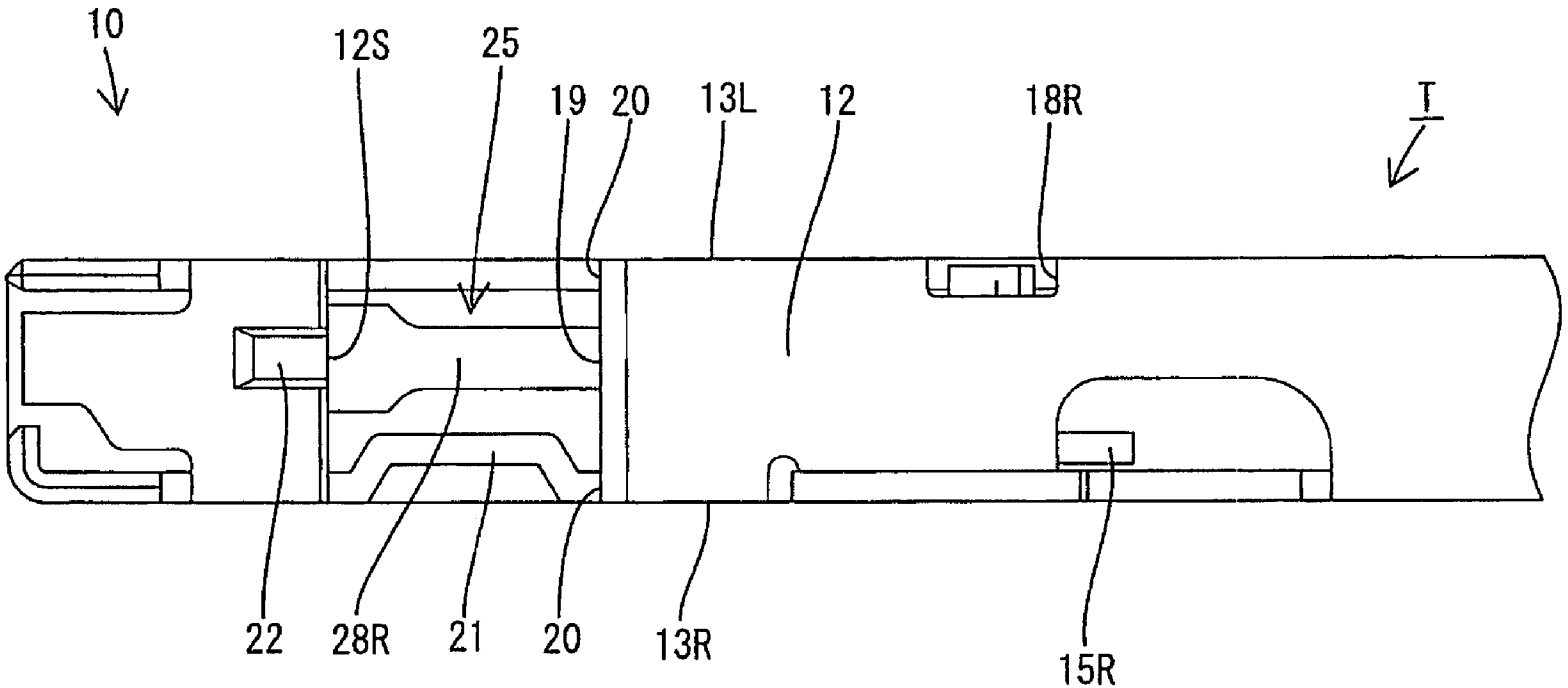
FIG. 4 is a bottom view of the terminal fitting.

Terminal fittings in accordance with the invention are identified by the letter T in FIGS. 1 to 12. The terminal fittings T are accommodated in a connector housing 50 made e.g. of a synthetic resin. Cavities 51 penetrate the housing 50 in forward and backward directions, and a lock 52 is cantilevered forward along the bottom wall of each cavity 51. A retaining projection 52*a* is formed on the surface of each lock 52 facing the cavity 51. A front plate 53 is mounted on the front surface of the housing 50, and tabs 54 of male terminal fittings mounted in an unillustrated mating connector are inserted from the front into the cavities 51 through tab insertion openings 55 in the front plate 53.

Figure 10:
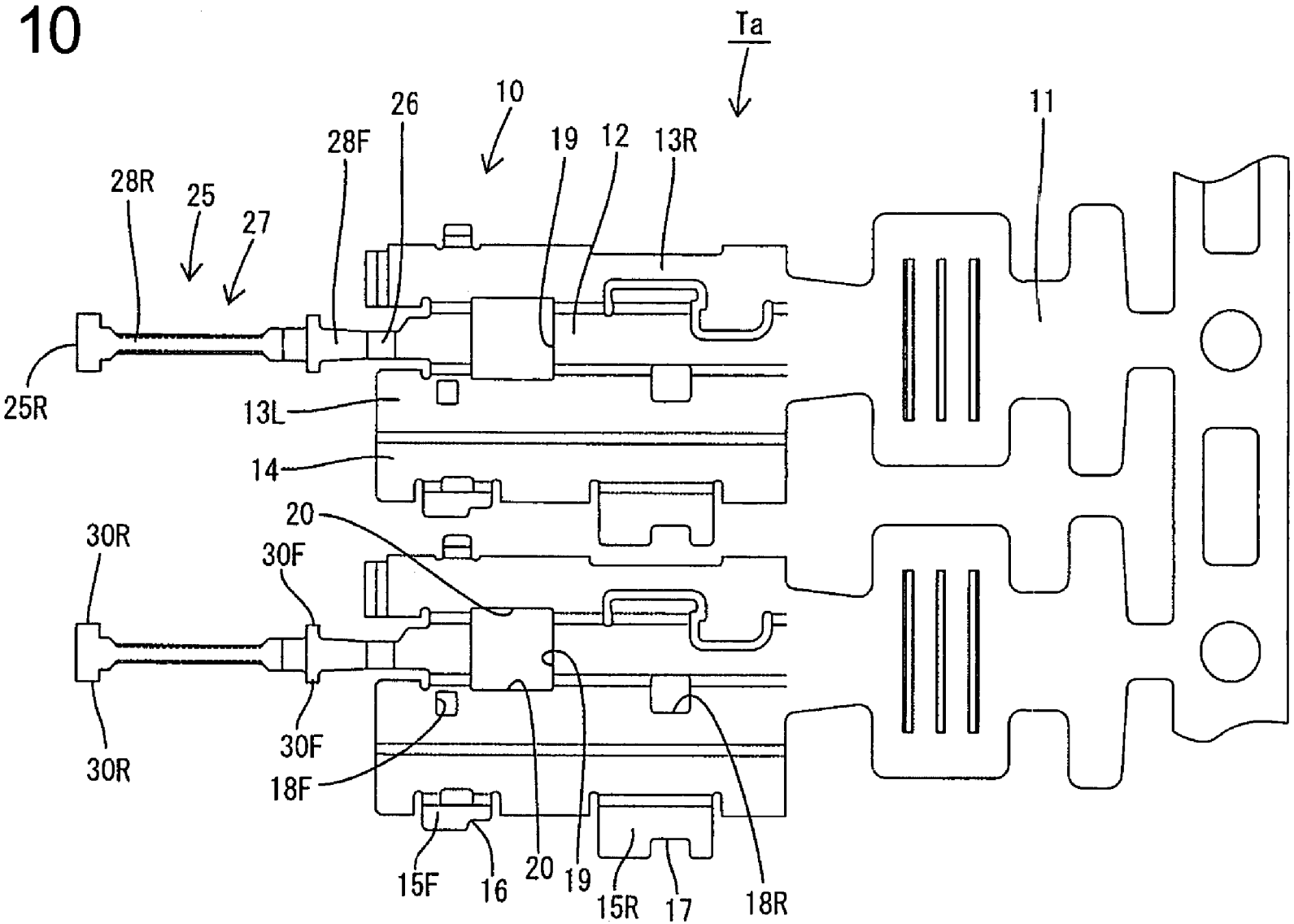
FIG. 10 is a development of the terminal fitting.
Figure 11:
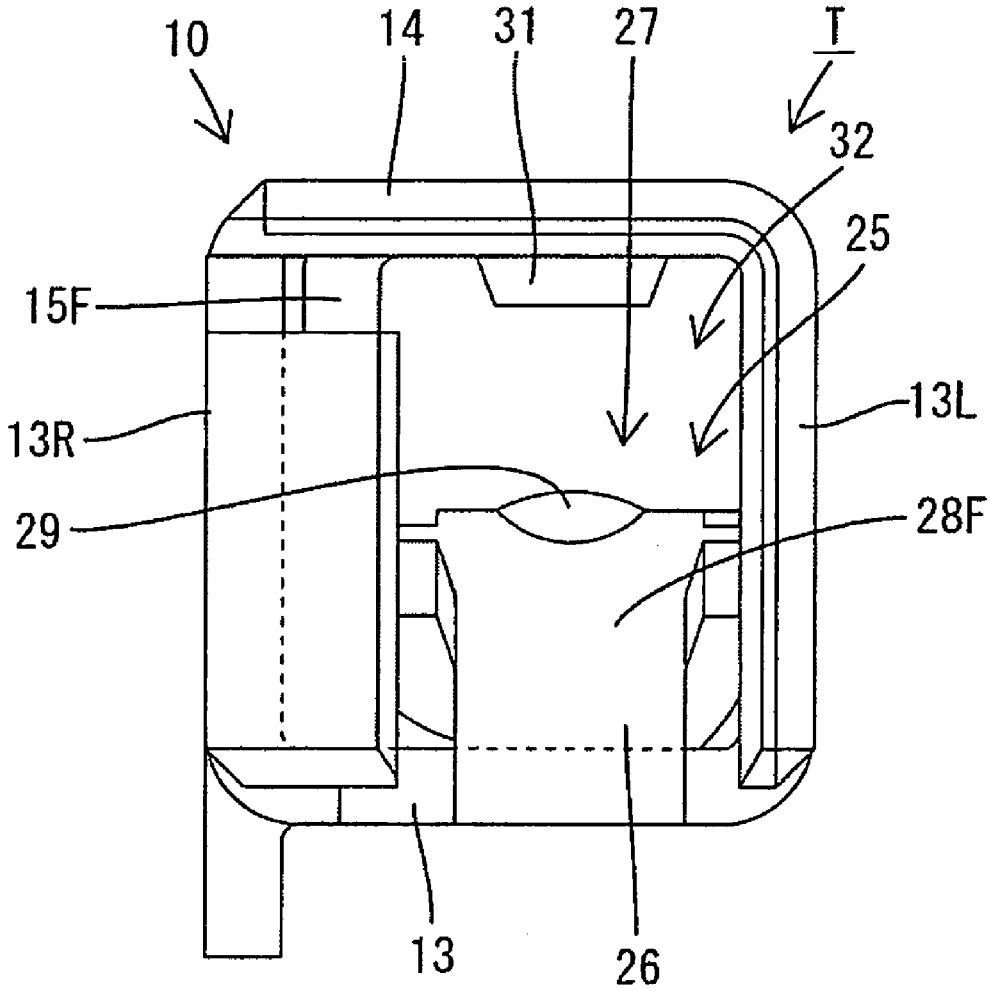
FIG. 11 is a front view of the terminal fitting.
Figure 12:
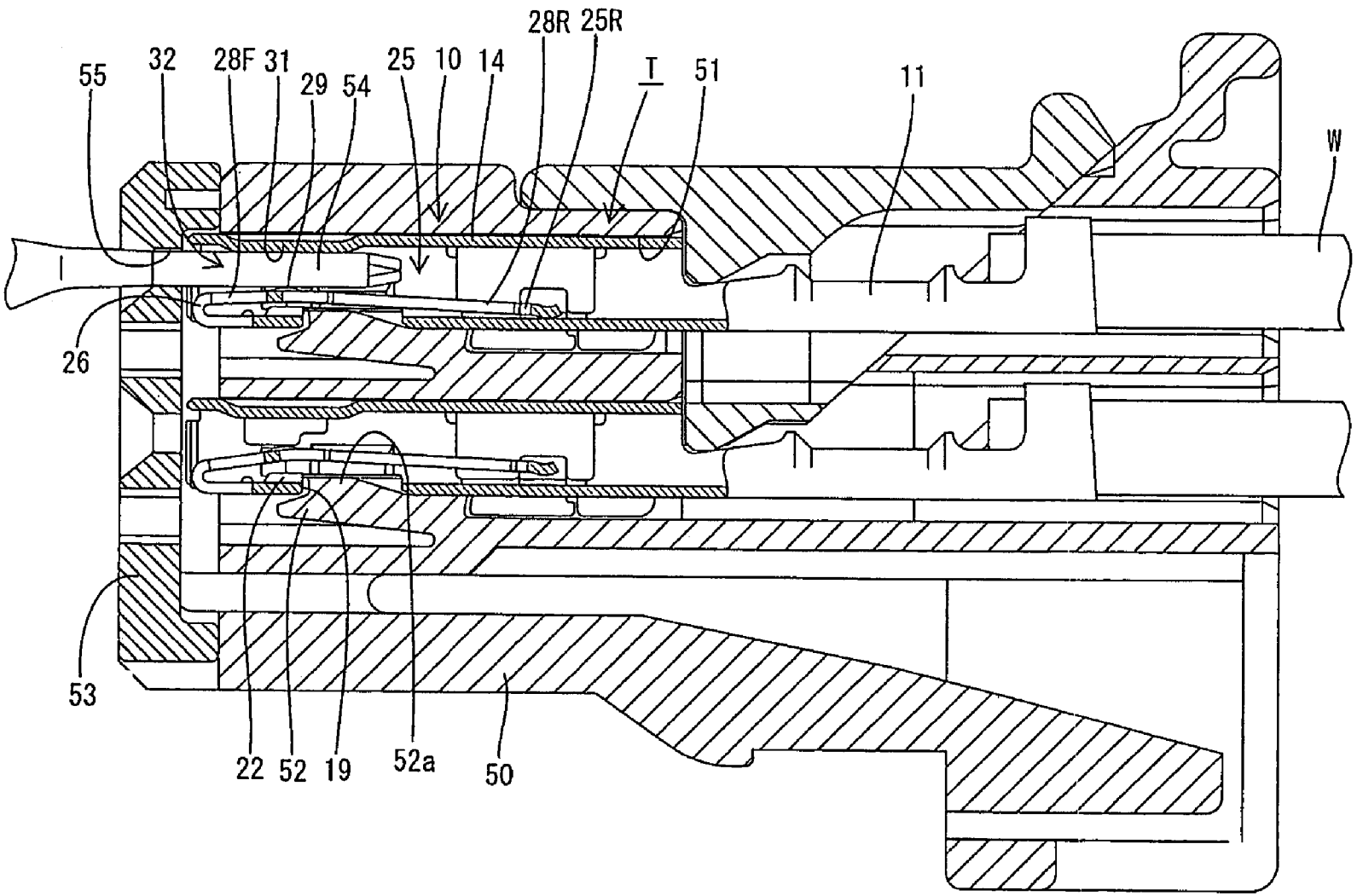
FIG. 12 is a section showing a state where a tab is connected with the terminal fitting.

Each terminal fitting T is made from a conductive metallic plate material Ta stamped or cut into a specified shape, as shown in FIG. 10, and then formed by bending, folding, pressing, embossing, etc. The terminal fitting T is narrow and long in forward and backward directions and has a substantially rectangular tube 10 formed at a front half and a wire connecting portion 11 at rear half. The wire connecting portion 11 is crimped, bent or folded into electrical connection, with an end of a wire W.

The rectangular tube 10 is substantially hollow in forward and backward directions and has a bottom plate 12 that is narrow and long in forward and backward directions. Side plates 13L, 13R project from front areas of the opposite left and right edges of the bottom plate 12. A ceiling plate 14 extends from the entire upper edge of the left side plate 13L towards the right side plate 13R and is substantially parallel with the bottom plate 12. Front, rear and middle parts of the extending right edge of the ceiling plate 14 contact the upper edge of the right side plate 13R from above. Front and rear locking plates 15F, 15R extend down towards the resilient contact piece 25 along the inner surface of the right side plate 13R. The locking plates 15F, 15R are formed in front and rear areas of the extending end of the ceiling plate 14 not in contact with the upper edge of the right side plate 13R. The front locking plate 15F is substantially rectangular and the bottom edge thereof is substantially in the middle of the rectangular tube 10 with respect to the height direction, and a rear notch 16 is formed at the rear end of the bottom edge. The rear locking plate 15R is substantially rectangular, and the bottom edge thereof is at a low position near the bottom plate 12 in the rectangular tube 10. A bottom notch 17 is formed substantially in the middle of the bottom edge with respect to forward and backward directions. On the other hand, a substantially rectangular front locking hole 18F corresponding to the bottom edge of the front locking plate 15F and a substantially rectangular rear locking hole 18R corresponding to the bottom notch 17 of the rear locking plate 15R penetrate the left side plate 13L.

A substantially rectangular locking hole 19 is formed in the bottom plate 12. The bottom edges of the left and right side plates 13L, 13R are cut up to a position slightly higher than the upper surface of the bottom plate 12 in areas corresponding to the locking hole 19 with respect to forward and backward directions, thereby transversely symmetrically forming side notches 20. The side notches 20 create bottom edges for the left and right side plates 13L, 13R at location in an opening area of the locking hole 19. An area of the bottom part of the right side plate 13R aligned with the locking hole 19 is embossed inward towards the widthwise center to forming an intrusion restriction 21. The intrusion restriction 21 is substantially rectangular in side view (see e.g. FIG. 3) and is trapezoidal in bottom view (see e.g. FIG. 4). It should be noted that the rear notch 16 of the front locking plate 15F is formed to avoid interference with the top front corner of the intrusion restriction 21.

The bottom plate 12 is stamped or embossed up and in adjacent the opening edge of the locking hole 19 to define a plastically deformed retaining portion 22 that is engageable with the retaining projection 52*a* of the lock 52. The retaining portion 22 includes a rearwardly facing edge 12S on a portion of the bottom plate 12 defining the locking hole 19. The edge 12S is oriented to oppose the retaining projection 52*a*. The retaining portion 22 is displaced laterally (e.g. to the left) along width direction relative to the rectangular tube 10. Further, the upper or inner surface of the retaining portion 22 is a substantially flat surface located at substantially the same height as the bottom edges of the side notches 20 and the intrusion restriction 21.

Figure 5:
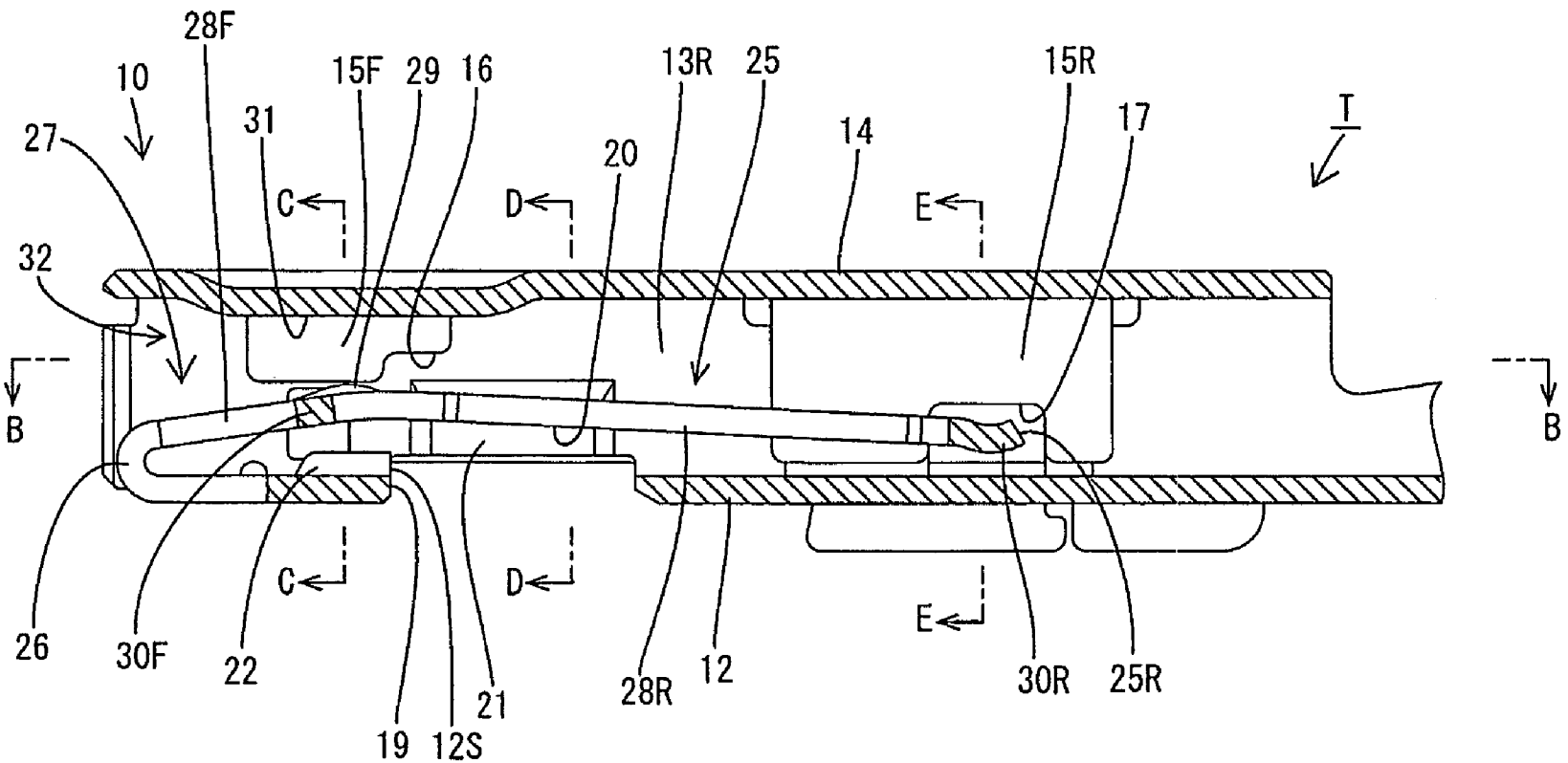
FIG. 5 is a section along 5—5 of FIG. 2.
Figure 6:
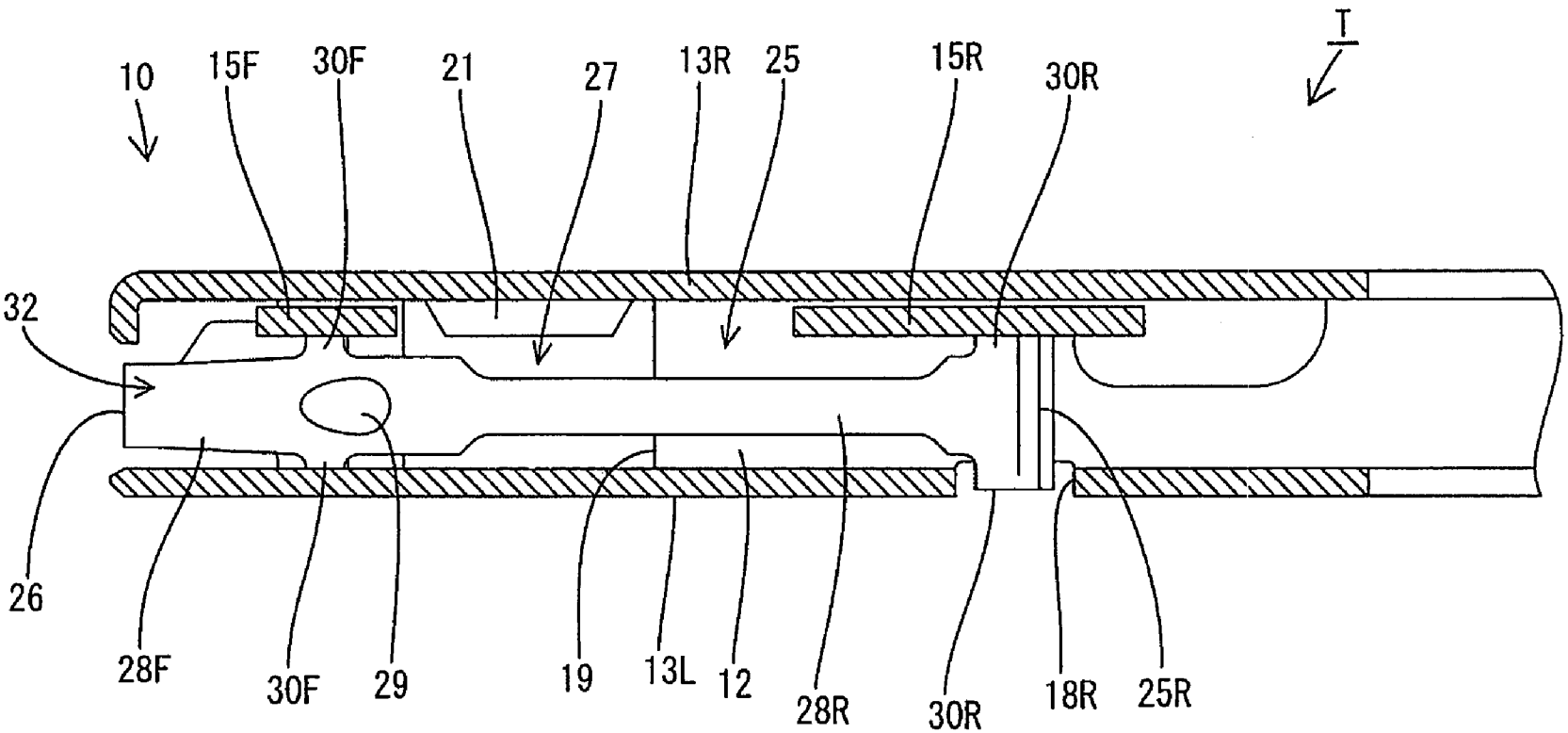
FIG. 6 is a section along 6—6 of FIG. 5.
Figure 7:
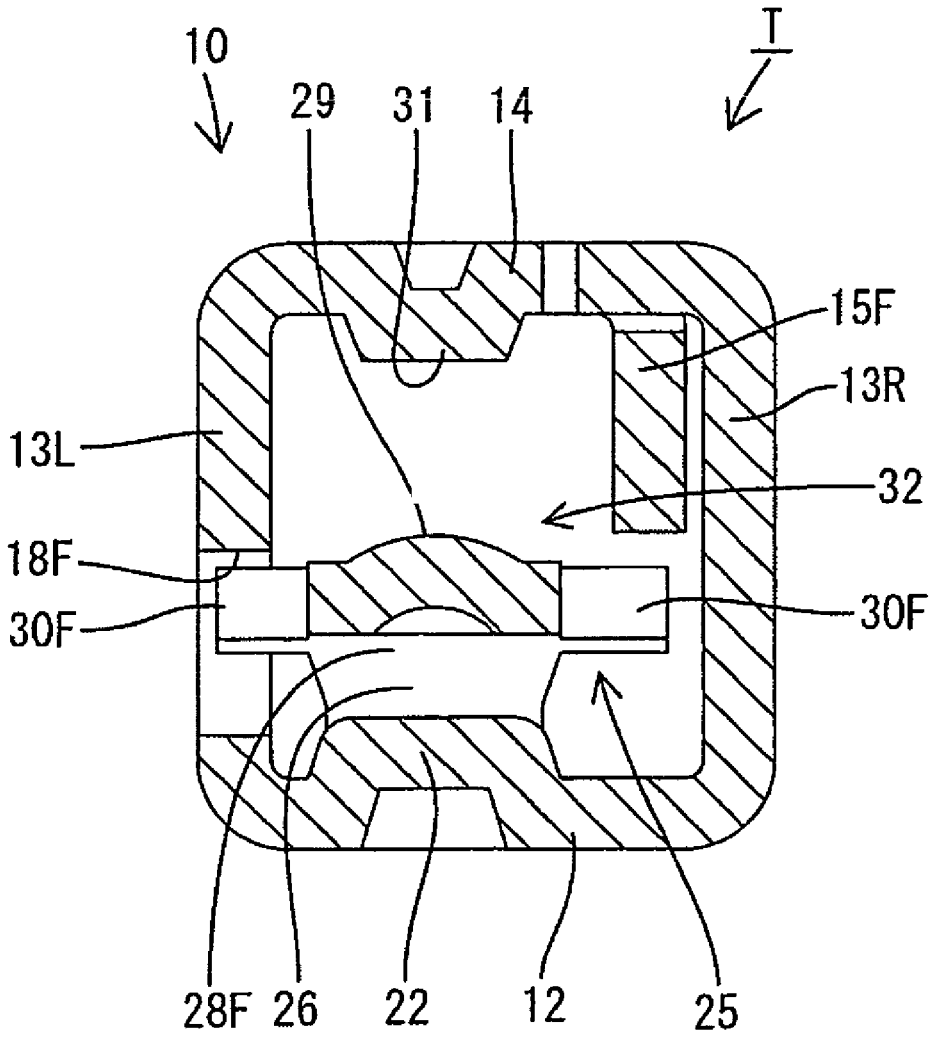
FIG. 7 is a section along 7—7 of FIG. 5.
Figure 8:
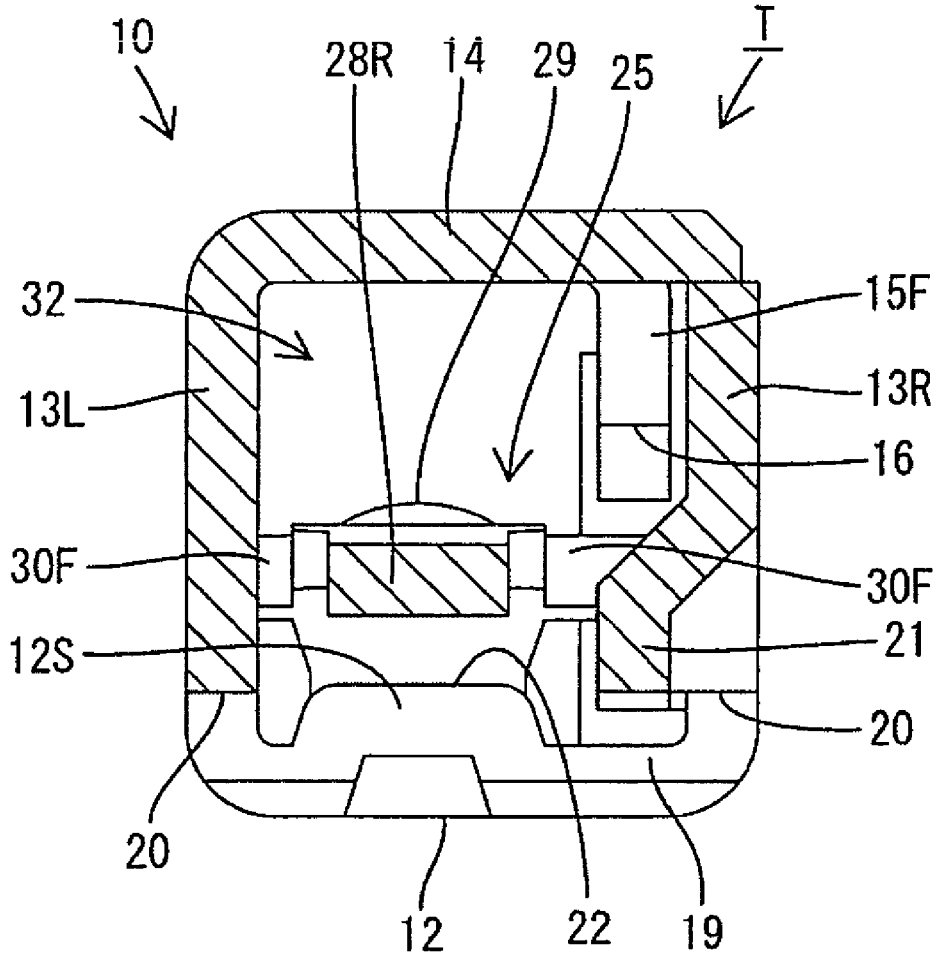
FIG. 8 is a section along 8—8 of FIG. 5.
Figure 9:
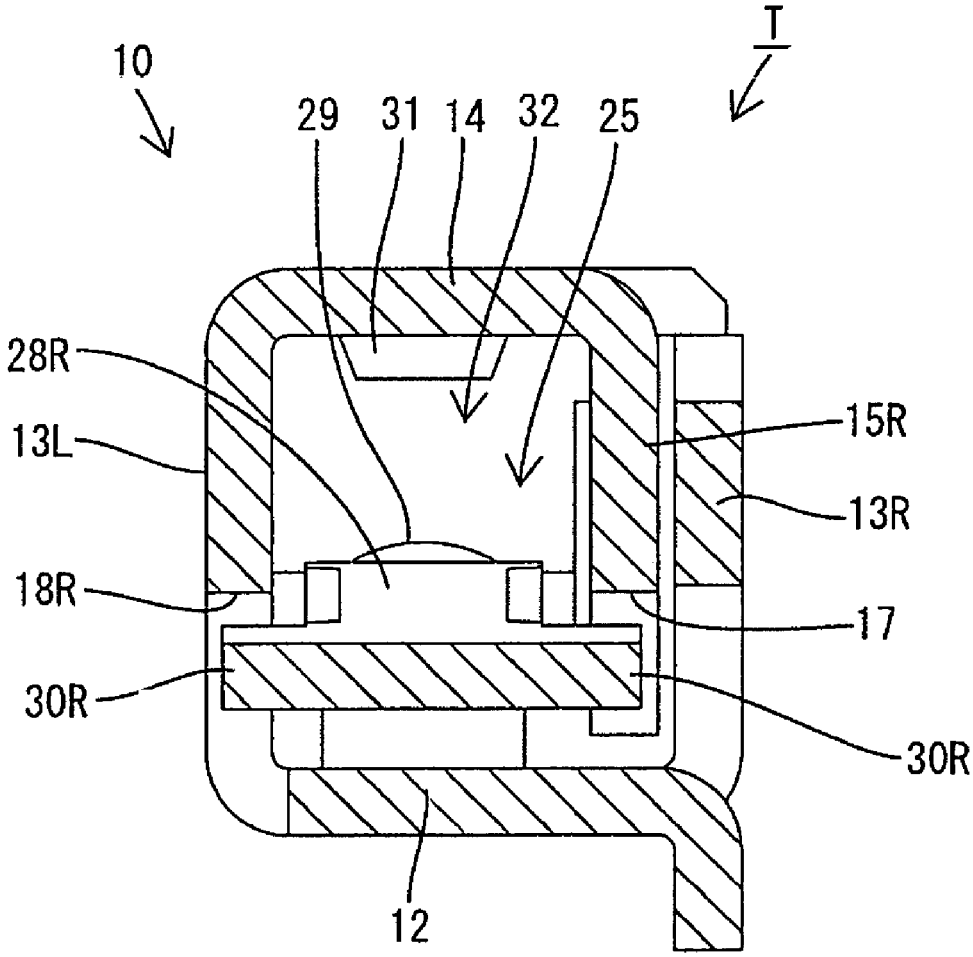
FIG. 9 is a section along 9—9 of FIG. 5.

A resilient contact 25 is accommodated in the rectangular tube 10. As shown in FIG. 5, the resilient contact 25 is long and narrow in forward and backward directions and is bent back from the front end of the bottom plate 12. Additionally, the resilient contact 25 is comprised of a substantially semicircular bend 26 connected with the front end of the bottom plate 12 and an extending portion 27 extending back from the bend 26. The extending portion 27 has a forwardly inclined section 28F extending obliquely up and to the back from the upper end of the bend 26 and a backward inclined section 28R extending obliquely down and out to the back from the rear end of the forwardly inclined section 28F. In a free undeformed state, the resilient contact 25 is supported only at its front end and a free end 25R at the rear of the backward inclined section 28R is at a noncontact position spaced up from the bottom plate 12. The resilient contact 25 is resiliently deformable up and down in a direction intersecting the forward and backward directions with the bend 26 as a supporting, while mainly deforming the bend 26. The free end 25R of the resilient contact 25 at rear of the backward inclined section 28R contacts the upper surface of the bottom plate 12 when the resilient contact 25 is deformed down. Thus, the deformed resilient contact 25 is supported at both front and rear ends.

The bend 26 and the forward inclined section 28F are located in an area before the locking hole 19, and a substantially dome-shaped contact point 29 project up at the rear end (i.e. highest part) of the forward inclined section 28F. The contact point 29 also is located before the locking hole 19. The backward inclined section 28R extends in an area from the front edge of the locking hole 19 to the bottom notch 17 of the rear locking plate 15R, and the front end thereof is at a height substantially corresponding to the intrusion restriction 21. Further, the widths of the bend 26 and the forward inclined section 28F are substantially equal. The widths of the front and rear ends of the backward inclined section 28R are substantially equal to the width of the forward inclined section 28F; and an area of the backward inclined section 28R except the front and rear ends thereof is narrower than the forward inclined section 28F.

Front and rear projections 30F, 30R project out in the width direction from each of the left and right edges of the resilient contact 25 and are be substantially flush with the resilient contact 25 in the thickness direction. The left and right front projections 30F are substantially symmetrical to each other and are near the front of the contact point 29. The front projections 30F are located to substantially correspond to the bottom edge of the front locking plate 15F and the front locking hole 18F with respect to forward and backward directions. In the free state where the resilient contact 25 is not deformed, the upper surface of the right front projection 30F is slightly below the bottom edge of the front locking plate 15F and is not in contact with this bottom edge, and the upper surface of the left front projection 30F is slightly below the upper edge of the front locking hole 18F and not in contact with this upper edge. On the other hand, the rear projections 30R are transversely symmetrical and are close to the free rear end 25R of the resilient contact 25. The rear projections 30R are located to correspond to the upper edge of the bottom notch 17 of the rear locking plate 15R and the rear locking hole 18R with respect to forward and backward directions. In the free state where the resilient contact 25 is not deformed, the upper surface of the right rear projection 30R is slightly below the upper edge of the bottom notch 17 and does not contact this upper edge, and the upper surface of the left rear projection 30R is slightly below the upper edge of the rear locking hole 18R and does not contact this upper edge.

The resilient contact 25 is substantially transversely symmetrical and displaced to the left along the width direction relative to the rectangular tube 10 and the locking hole 19. The widthwise center of the resilient contact 25 substantially coincides with that of the retaining portion 22. When the locking hole 19 is viewed from below, a front-end area of the backward inclined section 28R of the resilient contact 25 is exposed over substantially its entire width. The ceiling plate 14 includes a downwardly embossed tab receiving portion 31 with a widthwise center that substantially coincides with the widthwise center of the resilient contact 25. A tab entrance space 32 is defined between the upper surface of the resilient contact 25 and the lower surface of the tab receiving portion 31 for receiving the tab 54.

The terminal fitting T can be inserted into the cavity 51 of the housing 50 from behind. As a result, the bottom plate 12 of the rectangular tube 10 contacts with the retaining projection 52*a* to deform the lock 52 down. The lock 52 is restored resiliently when the terminal fitting T is inserted to a proper position. Thus, the retaining projection 52*a* fits into the locking hole 19, and the front surface of the retaining projection 52*a* engages the retaining portion 22 of the locking hole 19 from behind. As a result, the terminal fitting T is held and cannot be withdrawn. A tab 54 can be inserted from the front through the tab insertion opening 55 in the front plate 53 and into the tab entrance space 32. Thus, the tab 54 is held resiliently between the tab receiving portion 31 and the contact point 29 while resiliently deforming the resilient contact 25. The tab 54 and the rectangular tube 10 are connected electrically by a resilient restoring force of the resilient contact 25.

The edge 12S of the retaining portion 22 at the opening edge of the locking hole 19 in the bottom plate 12 contacts the lock 52 to retain the terminal fitting T. The edge 12S is displaced inwardly of the rectangular tube 10. Thus, a larger engaging margin can be ensured as compared to a case where only the thickness of the plate defines an engaging margin.

The retaining portion 22 is displaced into the rectangular tube 10 and the edge 12S of the bottom plate 12 is oriented to oppose the lock 52. A boundary between the lower surface of the bottom plate 12 and the edge 12S is well defined angled corner. Thus, even if an external force acts on the terminal fitting T in the withdrawing direction, there is no likelihood that the lock slips and disengages from the retaining portion as in the case where the boundary between the lower surface of the bottom plate and the end surface is a curve.

A portion of the resilient contact 25 corresponding to the contact point 29 engages the retaining portion 22 from above if a degree of downward deformation of the resilient contact 25 exceeds the deformation normally generated by the tab 54, thereby preventing deformation of the resilient contact 25 beyond its resiliency limit. The retaining portion 22 for retaining the terminal fitting T also prevents excessive deformation of the resilient contact 25. Thus, the shape of the terminal fitting T can be simplified as compared to a case where an excessive deformation preventing portion for exclusive use is provided in addition to the retaining portion.

External matter that intrudes through the locking hole 19 can push the resilient contact piece 25 up from below. However, the front projections 30F contact the bottom edge of the front locking plate 15F and the edge of the front locking hole 18F from below. Additionally, the rear projections 30R contact the bottom edge of the rear locking plate 15R and the edge of the rear locking hole 18R from below. Thus, the resilient contact 25 cannot be displaced up towards the tab entrance space 32. Further, the locking plates 15F, 15R and the locking holes 18F, 18R are positioned before and behind the locking hole 19. Thus, there is no likelihood that the resilient contact 25 is inclined forward and/or backward upon receiving a pushing force from external matter. This can prevent plastic deformation of the bent portion 26, which is the supporting point of resilient deformation of the resilient contact 25.

The front locking plate 15F and the front locking hole 18F are before the locking hole 19 and near the contact point 29 that contacts with the tab 54. Thus, even if an area of the resilient contact 25 other than the bent portion 26 is deformed, there is no likelihood of changing the position of the contact point 29. Therefore, the resilient contact 25 can contact with the tab 54 with a proper contact pressure.

The rear locking plate 15R and the rear locking hole 18R are behind the locking hole 19 and are near the free end 25R of the resilient contact piece 25. Thus, an interval along forward and backward directions between a front displacement preventing portion (front locking plate 15F and/or front locking hole 18F) and the rear displacement preventing portion (rear locking plate 15R and/or rear locking hole 18R) is long as compared to a case where the rear displacement preventing portion is closer to the supporting point of resilient deformation than to the free end. Accordingly, a degree of resilient deformation of the resilient contact 25 between the front and rear displacement preventing portions by being pressed by external matter can be suppressed, and the resilient contact 25 is unlikely to undergo a plastic deformation between the front and rear displacement preventing portions.

The bottom plate 12 has the locking hole 19 that exposes the resilient contact 25 to the outside of the rectangular tube 10. However, the right side plate 13R is formed with the intrusion restricting portion 21 close to the resilient contact 25 and at least partly within the opening area of the locking hole 19. Thus, the intrusion of external matter through the locking hole 19 is restricted by the intrusion restricting portion 21, which in turn prevents interference of external matter with the resilient contact 25.

The intrusion restricting portion 21 is outside a deformation space for the resilient contact 25 with respect to the width direction. Thus, the interference of the resilient contact 25 and the intrusion restricting portion 21 can be avoided. Accordingly, the contact reliability of the tab 54 and the resilient contact 25 can be ensured without hindering the resilient deformation of the resilient contact 25.

The widthwise center of resilient contact 25 is offset from that of the rectangular tube 10. Thus a dead space exists between the resilient contact 25 and the side plate 13R more distant from the resilient contact 25. However, the intrusion restricting portion 21 is in this dead space, and space is used efficiently.

The locking hole 19 is formed over substantially the entire width of the rectangular tube 10 and the bottom end surfaces of the left and right side plates 13L, 13R of the rectangular tube 10 are exposed in the opening area of the locking hole 19. The bottom end portion of the right side plate 13R facing the locking hole 19 is embossed to project inward, thereby forming the intrusion restriction 21. This embossing or stamping is easily workable as compared to cutting and bending. Therefore, a processing cost can be reduced.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The retaining portion is embossed in the widthwise middle of the bottom plate in the foregoing embodiment. However, the left and/or right edges of the bottom plate may be embossed according to the invention.

Although the retaining portion is formed by embossing in the foregoing embodiment, it may be formed by making a cut in the bottom plate and bending this cut portion according to the present invention.

The widthwise center of the resilient contact is offset from that of the rectangular tube in the foregoing embodiment.

However, the widthwise centers of resilient contacts and the rectangular tubes may coincide.

The retaining portion does not need to prevent excessive deformation of the resilient contact as in the foregoing embodiment.

Although the invention has been described with reference to a female terminal fitting, the invention is also applicable to a male terminal fitting.

What is claimed is:

1. A terminal fitting to be inserted into a cavity of a connector housing and to be held therein by an engagement with a lock of the connector housing, comprising:

a tube having opposite front and rear ends spaced apart along a longitudinal direction; and a locking hole formed in a wall of the tube and having an opening edge extending transverse to the longitudinal direction for engagement with the lock, the opening edge and portions of the wall adjacent the opening edge being displaced inwardly of the tube to define a retaining portion for engagement with the lock;

wherein the wall formed with the locking hole base wall of the tube, the tube further comprising first and second opposed side walls extending from the base wall, the opening edge extending continuously from the first side wall to the second side wall, and portions of the opening edge space inwardly from the first and second side walls being displaced inwardly into the tube;

wherein a resilient contact in the tube for deformation in a deforming direction, the resilient contact being disposed to contact the retaining portion to prevent an excessive deformation of the resilient contact.

2. The terminal fitting of claim 1, wherein a widthwise center of the resilient contact substantially coincides with a widthwise center of the retaining portion.

3. A terminal fitting having opposite front and rear ends spaced apart along a longitudinal direction of the terminal fitting, a substantially rectangular tube extending rearwardly from the front end of the terminal fitting, the tube having a base wall, first and second side walls extending substantially orthogonally from the base wall and a ceiling wall opposed to the base wall and extending between the first and second side walls, the base wall of the tube being formed with a locking hole having a rearwardly facing opening edge, the opening edge and portions of the base wall forward of the opening edge being deformed inwardly into the tube so that the opening edge extends non-linearly between the first and second side walls, whereby the opening edge defines a large engaging margin for engagement by a lock of a connector housing;

wherein a resilient contact is in the tube for deformation in a deforming direction, the resilient contact being disposed to contact the retaining portion to prevent an excessive deformation of the resilient contact.

4. The terminal fitting of claim 3, wherein a widthwise center of the resilient contact substantially coincides with a widthwise center of the retaining portion.

* * * * *